US008632167B2

(12) United States Patent
Shimada

(10) Patent No.: US 8,632,167 B2
(45) Date of Patent: Jan. 21, 2014

(54) LIQUID EJECTING HEAD AND LIQUID EJECTING APPARATUS

(75) Inventor: Masato Shimada, Chino (JP)

(73) Assignee: Seiko Epson Corporation, Tokyo (JP)

( * ) Notice: Subject to any disclaimer, the term of this patent is extended or adjusted under 35 U.S.C. 154(b) by 162 days.

(21) Appl. No.: 13/045,410

(22) Filed: Mar. 10, 2011

(65) Prior Publication Data

US 2011/0221832 A1 Sep. 15, 2011

(30) Foreign Application Priority Data

Mar. 11, 2010 (JP) ..... 2010-055171

(51) Int. Cl.
*B41J 2/045* (2006.01)

(52) U.S. Cl.
USPC ..... 347/68

(58) Field of Classification Search
None
See application file for complete search history.

(56) References Cited

U.S. PATENT DOCUMENTS

| | | | | |
|---|---|---|---|---|
| 6,502,928 | B1 | 1/2003 | Shimada et al. | |
| 8,118,412 | B2 | 2/2012 | Shimada | |
| 2002/0051040 | A1 | 5/2002 | Shimada et al. | |
| 2008/0074475 | A1 * | 3/2008 | Katayama | 347/70 |
| 2009/0231396 | A1 | 9/2009 | Yazaki | |
| 2009/0284568 | A1 | 11/2009 | Yazaki | |
| 2010/0149284 | A1 | 6/2010 | Yazaki | |

FOREIGN PATENT DOCUMENTS

| | | | |
|---|---|---|---|
| CN | 101544113 | A | 9/2009 |
| JP | 3114808 | B2 | 9/2000 |
| JP | 2002-120369 | A | 4/2002 |
| JP | 2009-172878 | A | 8/2009 |
| JP | 2009-234254 | A | 10/2009 |
| JP | 2010-137485 | A | 6/2010 |
| JP | 2010-149376 | A | 7/2010 |

* cited by examiner

*Primary Examiner* — Matthew Luu
*Assistant Examiner* — Erica Lin
(74) *Attorney, Agent, or Firm* — Kilpatrick Townsend & Stockton LLP

(57) ABSTRACT

A piezoelectric element includes a first electrode which is an individual electrode, a piezoelectric layer, and a second electrode which is a common electrode. The piezoelectric element is provided with a piezoelectric active section and a piezoelectric nonactive section so as to face the pressure generating chambers. The piezoelectric nonactive section extends to the outside of the pressure generating chambers. On the piezoelectric layer of the piezoelectric nonactive section, a stress controlling layer is provided which has the same direction of internal stress as internal stress of the second electrode and is electrically insulated from the second electrode.

5 Claims, 5 Drawing Sheets

LIQUID EJECTING HEAD AND LIQUID EJECTING APPARATUS

This application claims a priority to Japanese Patent Application No. 2010-055171 filed on Mar. 11, 2010 which is hereby expressly incorporated by reference herein in its entirety.

BACKGROUND

1. Technical Field

The present invention relates to a liquid ejecting head which ejects liquid droplets from a nozzle by displacement of a piezoelectric element, and a liquid ejecting apparatus.

2. Related Art

As an ink jet recording head which is a representative example of liquid ejecting heads which eject liquid droplets, for example, there is an ink jet recording head, which is provided with a flow path forming substrate forming a pressure generation chamber, and a piezoelectric element configured by a lower electrode disposed on one surface side of the flow path forming substrate, a piezoelectric layer disposed on the lower electrode, and an upper electrode disposed on the piezoelectric layer, and which ejects ink droplets from a nozzle by displacing a vibrating substrate by displacement of the piezoelectric element so as to apply pressure in the pressure generating chamber. In such a configuration of an ink jet recording head, when displacing a vibrating substrate by driving of the piezoelectric element, there is a problem that it is easy for cracks to be generated in a section of the vibrating substrate opposing an edge portion in the longitudinal direction of the pressure generating chamber.

In order to solve this problem, a piezoelectric element is provided with a piezoelectric active section which is a driving section in practice and a piezoelectric nonactive section which has a piezoelectric layer connected to the piezoelectric active section but is not driven in practice (for example, refer to Japanese patent No. 3114808).

By providing such a piezoelectric element with a piezoelectric nonactive section, when the piezoelectric element is driven, the amount of deforming of the vibrating substrate opposing the edge portion in the longitudinal direction of the pressure generating chamber is reduced and the generation of cracks in the vibrating substrate can be suppressed.

Here, the piezoelectric element is one configured by a first electrode (the lower electrode) which is an individual electrode disposed on the flow path forming substrate, a piezoelectric layer, and a second electrode (the upper electrode) which is a common electrode. Even in the case of a piezoelectric element with this configuration, the generation of cracks in the vibrating substrate can be suppressed by providing a piezoelectric active section and a piezoelectric nonactive section described above.

Furthermore, in the piezoelectric element where the second electrode is the common electrode, the piezoelectric nonactive section is formed by, for example, removing the second electrode. That is, the boundary of the piezoelectric active section and the piezoelectric nonactive section is defined by the edge portion of the second electrode. Even with this piezoelectric element, cracks in the vibrating substrate can be suppressed as described above by providing the piezoelectric nonactive section.

However, if the second electrode does not exist on the piezoelectric nonactive section, stress is concentrated in the boundary portion of the piezoelectric active section and the piezoelectric nonactive section, and there is a concern that cracks may be generated in this portion of the vibrating substrate. Explaining in further detail, since the second electrode which configures the piezoelectric element is, for example, formed of iridium or the like and has internal stress in a compression direction, in an initial state (a state where a voltage is not applied), the piezoelectric active section is pulled in practice in an opposite direction to the pressure generating chamber by the second electrode, and the second electrode side is bent and deformed to be convex in a cross section in a width direction (lateral direction) of the pressure generating chamber. On the other hand, in the piezoelectric nonactive section which is not provided with the second electrode, the first electrode side is bent and deformed to be convex, which is opposite to the piezoelectric active section. As a result, stress is concentrated in the boundary portion of the piezoelectric active section and the piezoelectric nonactive section, and there is a concern that cracks may be generated in that portion of the vibrating substrate.

It is particularly easy for this problem to occur in cases where the second electrode is the common electrode of the piezoelectric element. This is because if the second electrode is the common electrode of the piezoelectric element, since the area of the second electrode which configures the piezoelectric element (piezoelectric active section) becomes comparatively large, there is a large amount of bending of the piezoelectric active section in the initial state, compared to a case where the second electrode is the individual electrode.

SUMMARY

An advantage of some aspects of the invention is to provide a liquid ejecting head and a liquid ejecting apparatus in which cracks in a vibrating substrate in the boundary of a piezoelectric active section and a piezoelectric nonactive section is suppressed.

According to an aspect of the invention, there is provided a liquid ejecting head including a flow path forming substrate provided with a plurality of pressure generating chambers which each communicate with nozzles which eject liquid droplets and a piezoelectric element provided to correspond to each pressure generating chamber via a vibrating substrate on one surface side of the flow path forming substrate; wherein the piezoelectric element is configured by a first electrode which is provided on the flow path forming substrate and is independent for each of the piezoelectric elements, a piezoelectric layer provided on the first electrode, and a second electrode which is provided to continuously span over a plurality of piezoelectric elements on the piezoelectric layer and is shared by the plurality of piezoelectric elements; the piezoelectric element is provided with a piezoelectric active section, where the first electrode, the piezoelectric layer and the second electrode are laminated, and a piezoelectric nonactive section, which has the first electrode and the piezoelectric layer continuing from the piezoelectric active section but which is not voltage driven, so as to face the pressure generating chambers; the piezoelectric nonactive section extends to the outside of the pressure generating chambers, and on the piezoelectric layer of the piezoelectric nonactive section, a stress controlling layer is provided which has the same direction of internal stress as internal stress of the second electrode and is electrically insulated from the second electrode.

In the aspect of the invention, the piezoelectric active section and the piezoelectric nonactive section are bend and deformed to the same extent by the internal stress in the initial state where a voltage is not applied to the piezoelectric element. Accordingly, the generation of stress concentration at the boundary of the piezoelectric active section and the piezoelectric nonactive section is suppressed, and cracks in the vibrating substrate according to the stress concentration can be suppressed.

Here, it is preferable that the stress controlling layer is formed more to the inside than the edge portion in the longitudinal direction of the pressure generating chambers. Due to this, since there is no regulation of the bending and deforming of the stress controlling layer, the amount of bending and deforming of the piezoelectric active section and the amount of bending and deforming of the piezoelectric nonactive section can be made to be closer.

In addition, it is preferable that the stress controlling layer is configured by the same layer as the second electrode. Due to this, the amount of bending and deforming of the piezoelectric nonactive section can be made to be the same as the amount of bending and deforming of the piezoelectric active section.

Furthermore, it is preferable that the stress controlling layer extends to the outside in the lateral direction of the pressure generating chambers. Due to this, the amount of bending and deforming of the piezoelectric active section and the amount of bending and deforming of the piezoelectric nonactive section can be made to be even closer.

Furthermore, according to another aspect of the invention, there is provided a liquid ejecting apparatus including the liquid ejecting head. In the aspect of the invention, damage to the piezoelectric elements can be suppressed, and a liquid ejecting apparatus with improved reliability, durability and the like can be realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described in detail.

Figure 1:
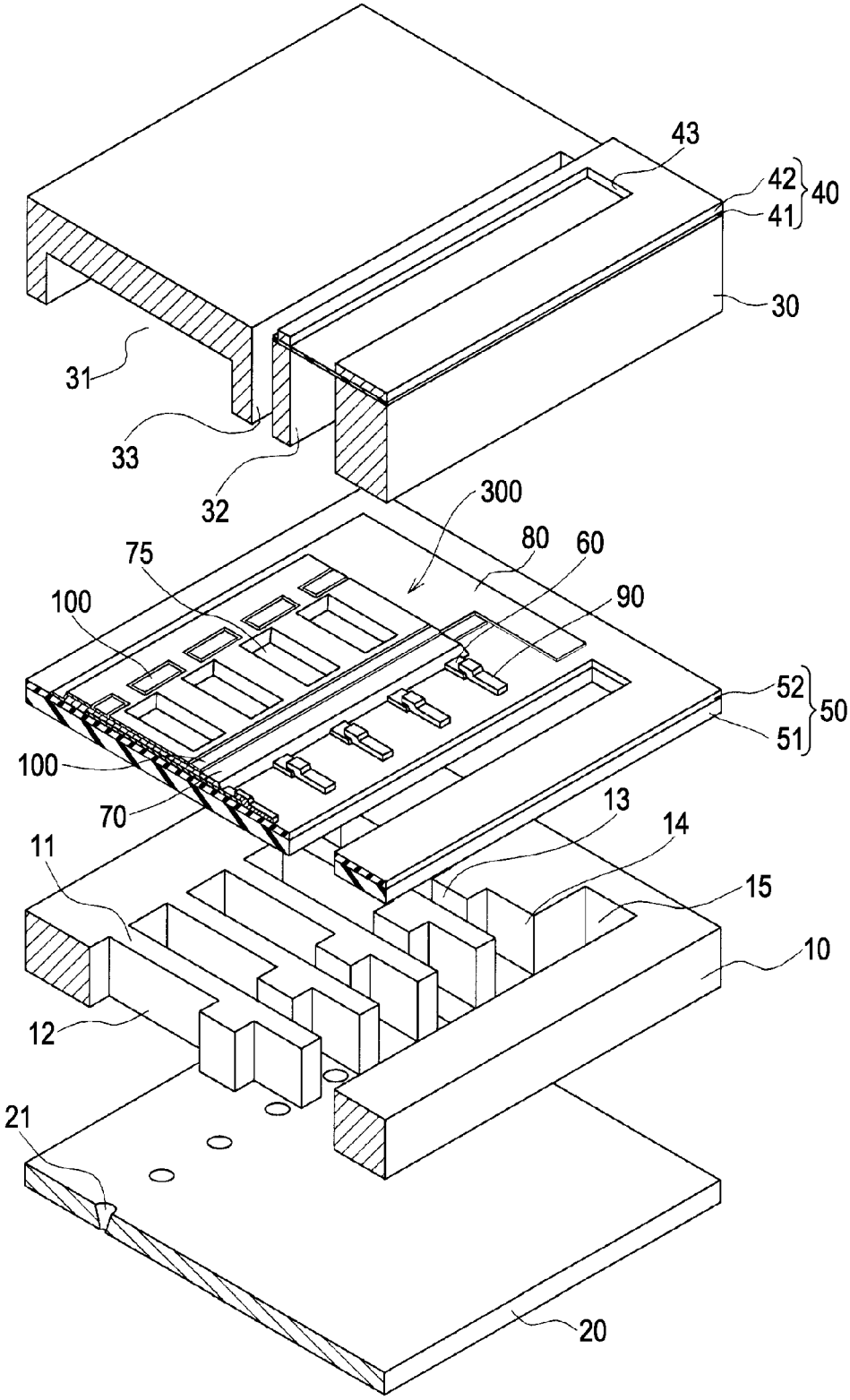
FIG. 1 is an exploded perspective diagram of a recording head related to an embodiment of the invention.
Figure 2A:
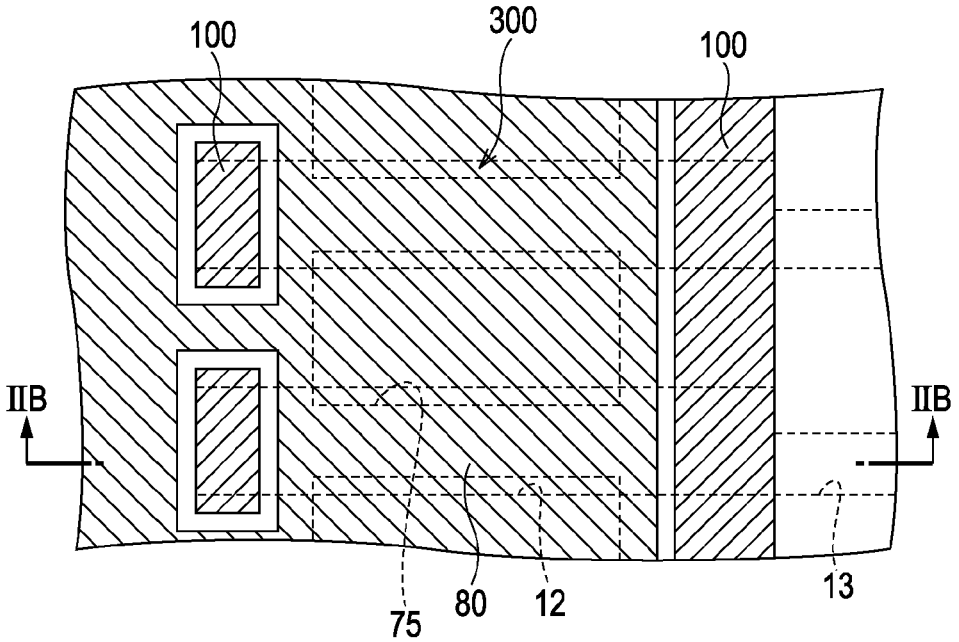
FIG. 2A is a planar diagram illustrating the configuration of a piezoelectric element related to an embodiment of the invention.
Figure 2B:
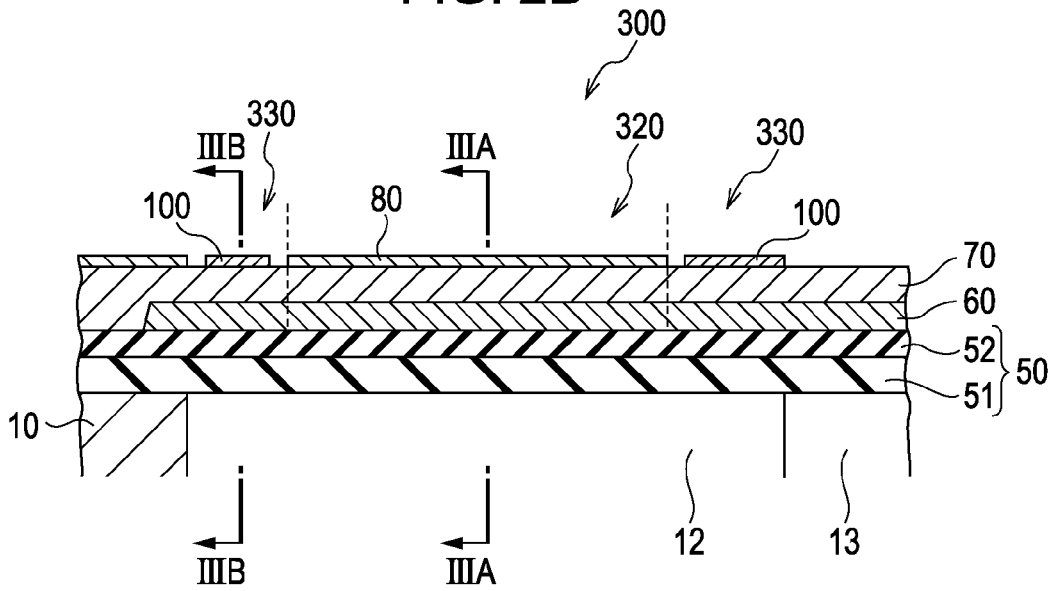
FIG. 2B is a cross-sectional diagram illustrating the configuration of the piezoelectric element related to an embodiment of the invention.
Figure 3A:
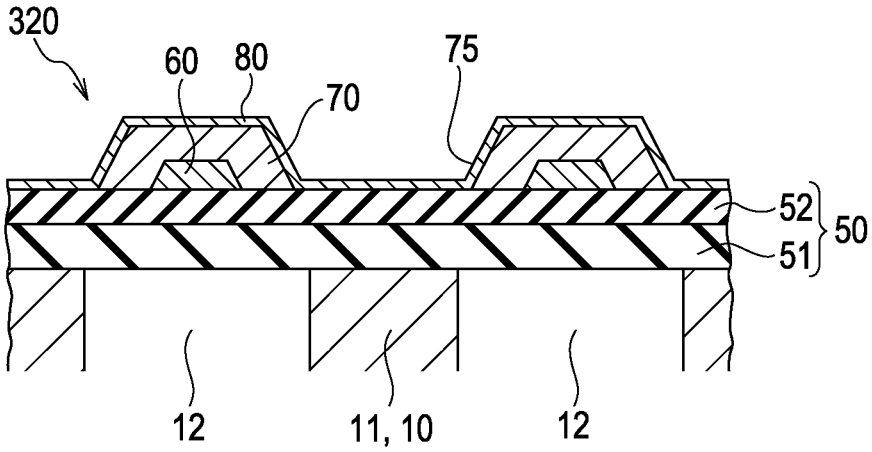
FIGS. 3A and 3B are cross-sectional diagrams illustrating the configuration of the piezoelectric element related to an embodiment of the invention.
Figure 3B:
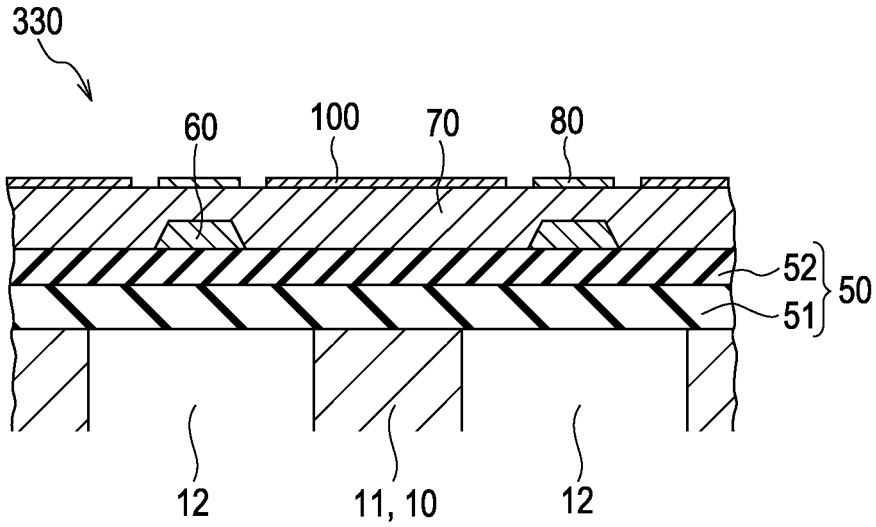

FIG. 1 is an exploded perspective diagram illustrating a schematic configuration of an ink jet recording head which is a liquid ejecting head related to an embodiment of the invention. FIG. 2A is a planar diagram of the configuration of a piezoelectric element and FIG. 2B is a cross-sectional diagram taken along line IIB-IIB of the configuration of a piezoelectric element. In addition, FIG. 3A is a cross-sectional diagram taken along the line IIIA-IIIA of FIG. 2B, and FIG. 3B is a cross-sectional diagram taken along the line IIIB-IIIB of FIG. 2B.

As shown in FIG. 1, in a flow path forming substrate 10 which configures the ink jet recording head, a plurality of pressure generating chambers 12 which are partitioned by partitions 11 are disposed in a width direction (lateral direction). Also, in the flow path forming substrate 10, on one edge portion side in the longitudinal direction of the pressure generating chambers 12, an ink supply path 13 and a communication path 14 are provided which are partitioned by the partitions 11 and communicates with each of the pressure generating chambers 12. On the outside of the communication paths 14, a communication section 15 is disposed which communicates with each of the communication paths 14.

The communication section 15 configures a portion of a reservoir which communicates with the reservoir section 32 of the protective substrate 30 described below and is an ink chamber (liquid chamber) shared by each of the pressure generating chambers 12. The ink supply path 13 is configured to have a cross-sectional area which is narrower than the pressure generating chambers 12, and maintains constant flow path resistance for ink flowing into the pressure generating chambers 12 from the communication section 15. The communication path 14 is formed by extending the partitions 11 on both sides in the width direction of the pressure generating chambers 12 to the communication section 15 side so as to partition a space between the ink supply path 13 and the communication section 15.

As a material for the flow path forming substrate 10, for example, it is appropriate to use a single crystal silicon substrate. However, also, glass ceramics, stainless steel or the like may be used.

On a surface on one side of the flow path forming substrate 10, a nozzle plate 20 provided with nozzles 21 is attached by an adhesive, a heat adhesion film or the like. The nozzle plate 20 is formed of, for example, glass ceramics, a single crystal silicon substrate, stainless steel or the like.

On a surface on the other side of the flow path forming substrate 10, for example, a vibrating substrate 50 is formed which includes an elastic film 51 formed by thermal oxidation of the flow path forming substrate 10. One surface side of the flow paths of the pressure generating chambers 12 and the like described above is formed by the vibrating substrate (the elastic film 51).

In this embodiment, an insulation film 52 is formed on the elastic film 51 from an oxidization film with a material different from the elastic film 51, and the vibrating substrate 50 is configured by the elastic film 51 and the insulation film 52. On the vibrating substrate 50, a piezoelectric element 300, which is configured by a lower electrode 60 which is a first electrode, a piezoelectric layer 70 and an upper electrode 80 which is a second electrode, is formed.

The piezoelectric element 300 typically sets either one of the electrodes as a common electrode and the other electrode as individual electrodes which are each independent. The piezoelectric element 300 of the embodiment of the invention is configured with the lower electrode 60 as the individual electrodes and the upper electrode 80 as the common electrode.

Here, the combination of the piezoelectric element 300 and the vibrating substrate 50 in which displacement is generated by driving of the piezoelectric element 300 is referred to as an actuator. In the example described above, the vibrating substrate 50 is configured by the elastic film 51 and the insulation film 52, but the configuration of the vibrating substrate 50 is not particularly limited. For example, the lower electrode 60 of the piezoelectric element 300 may also be used as the vibrating substrate 50, and the piezoelectric element 300 itself may function as the vibrating substrate 50.

Here, the configuration of the piezoelectric element 300 related to the embodiment is described in more detail. As shown in FIGS. 2A and 2B, the piezoelectric element 300 is provided with a piezoelectric active section 320 where the lower electrode 60, the piezoelectric layer 70 and the upper electrode 80 are laminated, and piezoelectric strain is generated by applying a voltage to both electrodes, and the piezoelectric element 300 is also provided with a piezoelectric nonactive section 330 which has the lower electrode 60 and the piezoelectric layer 70 continuing from the piezoelectric active section 320 but which is not voltage driven. The boundary of the piezoelectric active section 320 and the piezoelectric nonactive section 330 is defined by the edge portion of the upper electrode 80. In the embodiment, the piezoelectric active section 320 is provided to face the pressure generating chambers 12, and the piezoelectric nonactive section 330 is provided on both outsides in the longitudinal direction of the piezoelectric active section 320 and extends to the outside in the longitudinal direction of the pressure generating chambers 12.

The lower electrode 60 which is the individual electrode of the piezoelectric element 300 is formed so that the portion which faces each of the pressure generating chambers 12 has a width which is narrower than the width of the pressure generating chambers 12, and extends to the outside (above a peripheral wall) of both edge portions in the longitudinal direction of each of the pressure generating chambers 12. For example, lead electrodes 90 formed of gold (Au) or the like are connected to each of the lower electrodes 60 at a position more to the outside than one edge portion in the longitudinal direction of the pressure generating chambers 12, so that a voltage may be selectively applied to each of the piezoelectric elements 300 via the lead electrodes 90 (refer to FIG. 1).

There is a concave portion 75 in a portion of the piezoelectric layer 70, but the piezoelectric layer 70 is provided continuously to span a region facing the plurality of pressure generating chambers 12. The concave portion 75 is provided to face the partitions 11 which partition the pressure generating chambers 12. Due to this, as shown in FIG. 3A, the greater part of the piezoelectric layer 70 which configures the piezoelectric active section 320 is formed within a region which faces each of the pressure generating chambers 12 in the width direction of the pressure generating chambers 12. Also, as shown in FIG. 3B, the piezoelectric layer 70 which configures the piezoelectric nonactive section 330 is formed continuously to the outside of the pressure generating chambers 12 in the width direction of the pressure generating chambers 12. Here, the concave section 75 is formed by completely removing the piezoelectric layer 70 according to the embodiment, but may be formed by leaving a portion of the piezoelectric layer 70 in a thickness direction or by removing a portion of the upper part of the insulation layer 52 as well as the piezoelectric layer 70.

The upper electrode 80 is formed to continuously span a region facing the plurality of pressure generating chambers 12 on the piezoelectric layer 70 which includes the concave portion 75. In the region facing the pressure generating chambers 12, the edge portion of the upper electrode 80 in the longitudinal direction of the pressure generating chambers 12 is disposed on the pressure generating chambers 12. The boundary of the piezoelectric active section 320 and the piezoelectric nonactive section 330 is defined by the edge portion of the upper electrode 80. Here, in the embodiment, the upper electrode 80 has a two-layer structure formed from the same material, and the first layer is also used as a mask for patterning the piezoelectric layer 70.

On the piezoelectric layer 70 of the piezoelectric nonactive section 330, a stress controlling layer 100 is provided which has the same direction of internal stress as internal stress of the upper electrode 80 and is electrically insulated from the upper electrode 80. In the embodiment, the stress controlling layer 100 is provided at a position more to the inside than the edge portion in the longitudinal direction of the pressure generating chambers 12, that is, within a region facing the pressure generating chambers 12. Also, the stress controlling layer 100 extends to the outside of the pressure generating chambers 12 in the width direction of the pressure generating chambers 12.

The materials and formation method of the stress controlling layer 100 are not particularly limited and may be appropriately determined in consideration of the internal stress of the upper electrode 80. However, in the embodiment, the stress controlling layer 100 is formed of the same material as the upper electrode 80. That is, at the time when a metal film is formed on the entire surface of the piezoelectric layer 70 and then the metal film is patterned to form the upper electrode 80, the metal film is left on the piezoelectric nonactive section 330 to electrically insulate the upper electrode 80.

By providing the stress controlling layer 100 on the piezoelectric nonactive section 330 in this manner, the amount of bending (the amount of deforming according to the internal stress) in the initial state of the piezoelectric active section 320 and the piezoelectric nonactive section 330 can be controlled (adjusted) to be to the same extent. Due to this, stress concentration at the boundary portion of the piezoelectric active section 320 and the piezoelectric nonactive section 330 can be suppressed, and cracks in the vibrating substrate 50 caused by the stress concentration can be suppressed.

For example, in the embodiment, since the upper electrode 80 is formed from a material such as iridium or the like which has compression stress, the piezoelectric active section 320 is bent and deformed due to the internal stress so that the upper electrode 80 side becomes convex in the cross section of the width direction of the pressure generating chambers 12. Contrary to this, when the piezoelectric nonactive section 330 is configured by the lower electrode 60 and the piezoelectric layer 70, the piezoelectric nonactive section 330 is bent and deformed due to the internal stress so that the lower electrode 60 side becomes convex. However, by providing the stress controlling layer 100 on the piezoelectric nonactive section 330, the piezoelectric nonactive section 330 is bent and deformed so that the upper electrode 80 side becomes convex to the same extent as the piezoelectric active section 320. Accordingly, stress concentration is not generated at the boundary portion of the piezoelectric active section 320 and the piezoelectric nonactive section 330, and cracks in the vibrating substrate 50 caused by the stress concentration can be suppressed.

In particular, in the embodiment, since the stress controlling layer 100 is formed so as to be only within the region facing the pressure generating chambers 12, the bending and deforming of the stress controlling layer 100 is not regulated by the flow path forming substrate 10. As a result, the amount of bending of the piezoelectric nonactive section 330 which includes the stress controlling layer 100 can be made to match in practice with the amount of bending of the piezoelectric active section 320. Accordingly, stress concentration at the boundary portion of the piezoelectric active section 320 and the piezoelectric nonactive section 330 can be more reliably suppressed.

Here, the stress controlling layer 100 extends to the outside of the pressure generating chambers 12 in the width direction of the pressure generating chambers 12 as described above. The amount of deforming of the piezoelectric element 300 in the cross section of the edge portion in the longitudinal direction of the pressure generating chambers 12 is smaller than the amount of deforming of the piezoelectric element 300 in the edge portion in the width direction of the pressure generating chambers 12. As a result, in the width direction of the pressure generating chambers 12, even if extended to the outside of the pressure generating chambers 12, almost none of the deforming of the stress controlling layer 100 can be prevented. Also, by extension to the outside of the pressure generating chambers 12, when the piezoelectric element 300 is driven, stress concentration at the vibrating substrate 50 corresponding to the edge portion of the pressure generating chambers 12 can be suppressed, and according to this, there is also an effect that cracks in the vibrating substrate 50 can be suppressed.

Also, in the embodiment, the upper electrode 80 extends from above the partition 11 to the outside of the other edge portion in the longitudinal direction of the pressure generating chambers 12 and is formed to be continuous along the width direction of the pressure generating chambers 12 even in the region in the outside of the other edge portion in the longitudinal direction of the pressure generating chambers 12. In this configuration, since a comparatively wide area for the upper electrode 80 which is the common electrode of the piezoelectric element 300 can be secured, the generation of a drop in voltage or the like can be suppressed so that the piezoelectric element 300 can be effectively driven.

Returning to FIG. 1, on the flow path forming substrate 10 formed by the piezoelectric element 300, the protective substrate 30, which has a piezoelectric element holding section 31 which is a space for protecting the piezoelectric element 300, is bonded by an adhesive or the like. As the piezoelectric element 300 is formed inside of the piezoelectric element holding section 31, the piezoelectric element 300 is protected in a state where it receives almost no influence from the external environment. Also, in the protective substrate 30, the reservoir section 32 is provided in a region corresponding to the communication section 15 of the flow path forming substrate 10. As described above, the reservoir section 32 configures a reservoir which communicates with the communication section 15 of the flow path forming substrate 10 and is an ink chamber shared by each of the pressure generating chambers 12.

Furthermore, in a region between the piezoelectric element holding section 31 and the reservoir section 32 of the protective substrate 30, a through hole 33 is provided which penetrates through the protective substrate 30 in a thickness direction, and the edge portion of the upper electrode 80 and the lead electrode 90 are exposed in the through hole 33. In addition, although not shown, the upper electrode 80 and the lead electrode 90 are connected to a driving IC or the like in order to drive the piezoelectric element 300 by a connecting wire extending inside of the through hole 33.

Furthermore, a compliance substrate 40 formed of a sealing film 41 and a fixing substrate 42 is bonded on the protective substrate 30. The sealing film 41 is formed from a material with flexibility and low rigidity, and due to the sealing film 41, one surface of the reservoir section 32 is sealed. The fixing substrate 42 is formed from a hard material such as metal or the like. Since a region of the fixing substrate 42 facing the reservoir section 32 becomes an opening section 43 which has been completely removed in a thickness direction, one surface of the reservoir section 32 is sealed only by the sealing film 41 having flexibility.

In the ink jet recording head of the embodiment, after ink is input from an external ink supply unit (not shown) and the inside of the flow path is filled up by ink until it reaches the nozzles 21, a voltage is applied to each of the piezoelectric elements 300 corresponding to the pressure generating chambers 12 according to recording signals from a driving IC (not shown), so that the piezoelectric elements 300 are bent and deformed and pressure inside of the pressure generating chambers 12 is increased, thereby ink droplets are ejected from each of the nozzles 21.

One embodiment of the invention has been explained above, but the invention is not limited to the embodiment.

For example, in the embodiment described above, the stress controlling layer 100 is provided within the region facing the pressure generating chambers 12 in the longitudinal direction of the pressure generating chambers 12. However, the configuration of the stress controlling layer 100 is not limited to this.

Figure 4:
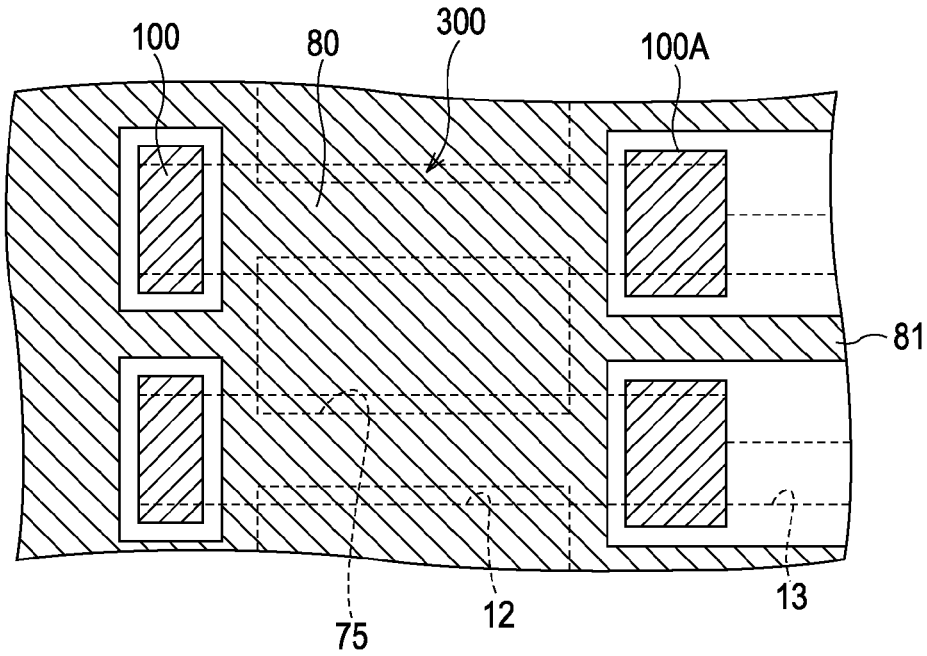
FIG. 4 is a planar diagram illustrating the configuration of a modified example of the piezoelectric element related to an embodiment of the invention.

For example, in the embodiment described above, the stress controlling layer 100 on one edge side in the longitudinal direction of the pressure generating chambers 12 is formed to be continuous along the width direction of the pressure generating chambers 12. However, for example, as shown in FIG. 4, a stress controlling layer 100A may be provided independently for each pressure generating chamber 12. In this configuration, in addition, the upper electrode 80 may be provided with extensions 81 which extend between each of the stress controlling layers 100A to the outside of the pressure generating chambers 12, and although not shown, the extensions 81 may be electrically connected to each other at a region more to the outside than the stress controlling layers 100A. Due to this, since the resistance value of the upper electrode 80 which is the common electrode of the piezoelectric element 300 can be reduced in practice, and the generation of a drop in voltage or the like can be suppressed so that the piezoelectric element 300 can be more effectively driven.

Figure 5:
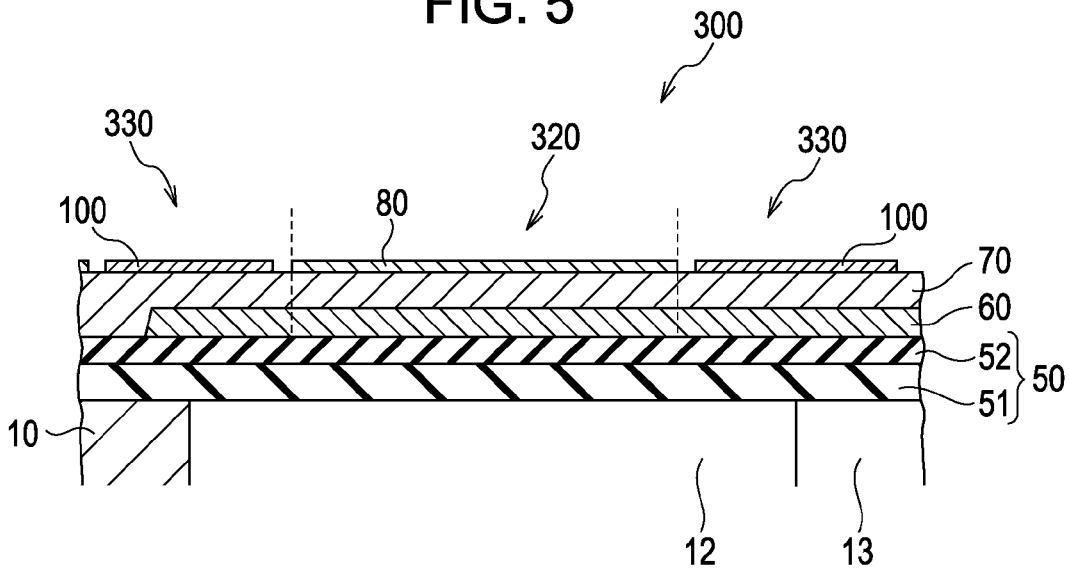
FIG. 5 is a cross-sectional diagram illustrating the configuration of a modified example of the piezoelectric element related to an embodiment of the invention.

Also, for example, as shown in FIG. 5, the stress controlling layer 100 may extend to the outside of the pressure generating chambers 12 in the longitudinal direction of the pressure generating chambers 12. In this case, the amount of deforming of the stress controlling layer 100 (the amount of deforming of the piezoelectric nonactive section 330) in the initial state may be slightly reduced, but stress concentration at the boundary of the piezoelectric active section 320 and the piezoelectric nonactive section 330 can be sufficiently suppressed. Also, in this configuration, when the piezoelectric element 300 is driven, stress concentration at the vibrating substrate 50 corresponding to the edge portion in the longitudinal direction of the pressure generating chambers 12 is suppressed, and according to this, cracks in the vibrating substrate 50 can be suppressed.

Figure 6:
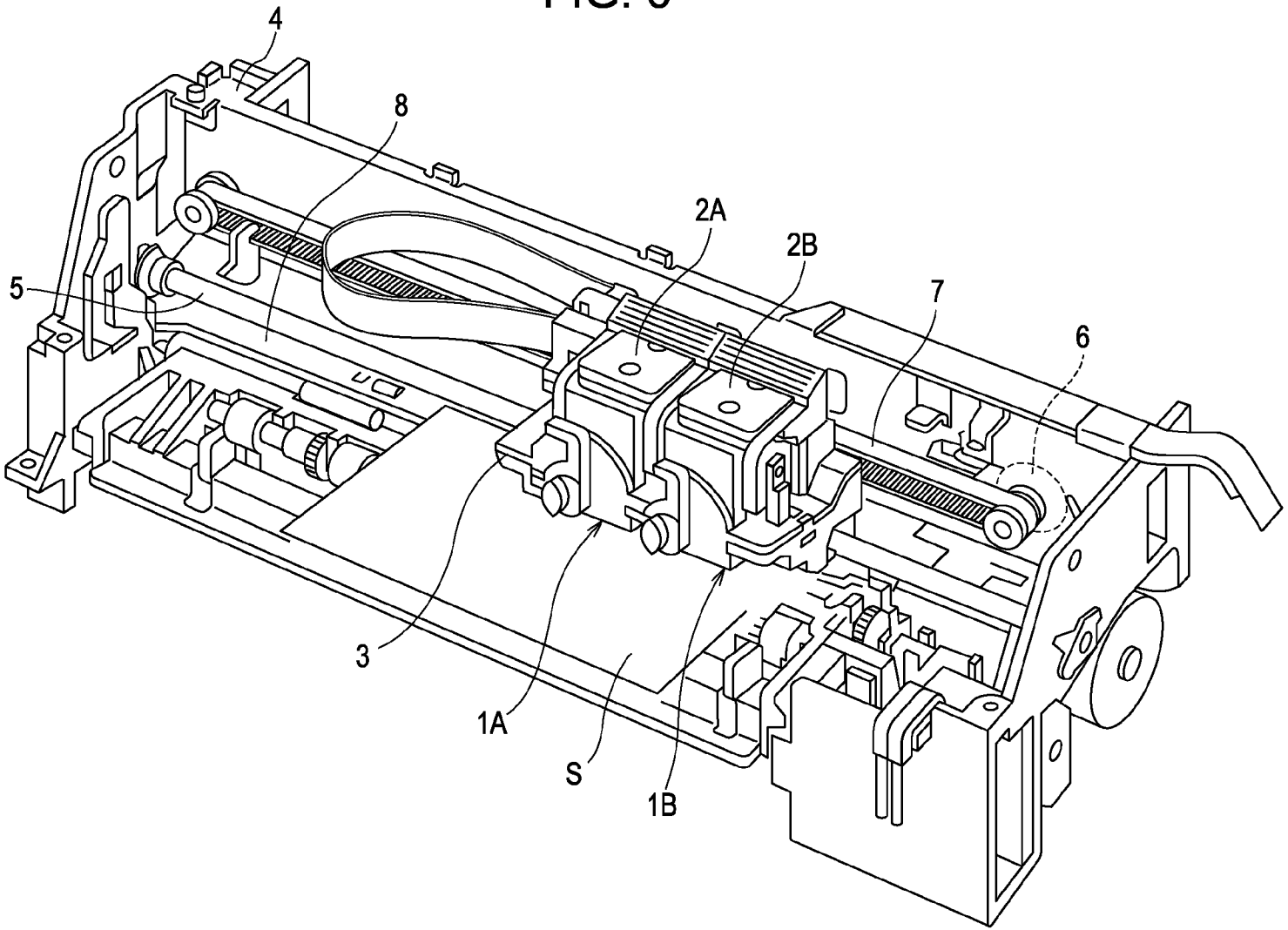
FIG. 6 is a schematic diagram of a recording apparatus related to an embodiment of the invention.

Here, the ink jet recording head configures a portion of a recording head unit provided with an ink flow path connected to an ink cartridge or the like, and is mounted in a ink jet recording apparatus. FIG. 6 is a schematic diagram illustrating an example of this ink jet recording apparatus. As shown in FIG. 6, recording head units 1A and 1B which have ink jet recording heads are provided with cartridges 2A and 2B, which configure ink supply units, so as to be attachable and detachable. A carriage 3 which is mounted with the recording head units 1A and 1B is provided on a carriage axis 5, which is attached to the apparatus main body 4, so as to be able to freely move in an axial direction. The recording head units 1A and 1B are each set to discharge, for example, a black ink composition and a color ink composition. In addition, by transferring the driving force of a driving motor 6 to the carriage 3 via a plurality of gears (not shown) and a timing belt 7, the carriage 3 with the recording head units 1A and 1B mounted thereon is moved along the carriage axis 5. On the other hand, in the apparatus main body 4, a platen 8 is provided along the carriage axis 5, and a recording sheet S, which is a recording medium such as paper or the like fed by a paper feeding roller or the like (not shown), is transported on the platen 8.

Also, in the embodiment described above, as an example of the liquid ejecting head of the invention, an ink jet recording head was described, but the basic configuration of the liquid ejecting head is not limited to the configuration described above. According to the aspect of the invention, it is possible for the invention to be applied to a broad range of liquid ejecting heads and is, of course, also appropriate for liquid ejecting heads ejecting liquids other than ink. As other liquid ejecting heads, for example, there are various types of recording heads used in image recording apparatuses such as printers and the like, coloring material ejecting heads used in the manufacturing of color filters for liquid crystal displays and the like, electrode material ejecting heads used in forming electrodes for organic EL displays, FEDs (field emission displays) and the like, bioorganic material ejecting heads used in manufacturing biochips, and the like.

What is claimed is:

1. A liquid ejecting head comprising:

a flow path substrate provided with a plurality of pressure generating chambers which each communicate with nozzles configured to eject liquid droplets; and a piezoelectric element corresponding to each one of the plurality of pressure generating chambers, the piezoelectric element being provided, via a vibrating substrate, on a side of the flow path substrate, wherein the piezoelectric element comprises:

a first electrode which is provided on the flow path substrate and is independent for each piezoelectric element, a piezoelectric layer provided on the first electrode, and a second electrode which continuously spans over a plurality of piezoelectric elements on the piezoelectric layer and is shared by the plurality of piezoelectric elements;

wherein the piezoelectric element is provided with:

a piezoelectric active section, in which the first electrode, the piezoelectric layer, and the second electrode are laminated, and a piezoelectric nonactive section facing the pressure generating chambers and extending beyond an edge of the pressure generating chambers, in which the first electrode and the piezoelectric layer extend from the piezoelectric active section, wherein the piezoelectric nonactive section is not voltage driven, and a stress controlling layer disposed on the piezoelectric layer of the piezoelectric nonactive section, wherein the stress controlling layer has the same direction of internal stress as internal stress of the second electrode and is electrically insulated from the second electrode and from any voltage driving source.

2. The liquid ejecting head according to claim 1, wherein the stress controlling layer is formed more to the inside than the edge in the longitudinal direction of the pressure generating chambers.

3. The liquid ejecting head according to claim 1, wherein the stress controlling layer is configured by the same layer as the second electrode.

4. The liquid ejecting head according to claim 1, wherein the stress controlling layer extends to the outside in the lateral direction of the pressure generating chambers.

5. A liquid ejecting apparatus provided with a liquid ejecting head according to claim 1.

* * * * *